US010989493B1

(12) United States Patent
Kung et al.

(10) Patent No.: US 10,989,493 B1
(45) Date of Patent: Apr. 27, 2021

(54) TOY GUN WITH SIMULATED SHAKING BULLET CHAIN

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 0 days.

(21) Appl. No.: 17/139,934

(22) Filed: Dec. 31, 2020

(30) Foreign Application Priority Data

Nov. 25, 2020 (TW) ..... 109215518

(51) Int. Cl.

| | |
|---|---|
| ***F41B 11/00*** | (2013.01) |
| ***F41B 7/08*** | (2006.01) |
| ***F41A 33/00*** | (2006.01) |
| ***F41A 33/06*** | (2006.01) |
| ***F41B 11/89*** | (2013.01) |

(52) U.S. Cl.
CPC ..... *F41B 7/08* (2013.01); *F41A 33/06* (2013.01); *F41B 11/89* (2013.01)

(58) Field of Classification Search
CPC .. F41B 7/08; F41B 11/00; F41B 11/50; F41B 11/89; F41A 9/76; F41A 9/79; F41A 33/06
USPC ..... 446/473; 124/1, 45, 82; 89/33.2; 42/54, 42/55
See application file for complete search history.

(56) References Cited

U.S. PATENT DOCUMENTS

| | | | | |
|---|---|---|---|---|
| 3,369,535 A * | 2/1968 | Bonanno | F41B 7/006 | 124/29 |
| 4,654,008 A * | 3/1987 | Elmore | F41A 33/04 | 42/55 |
| 5,433,646 A * | 7/1995 | Tarng | F41B 9/0018 | 446/473 |
| 5,569,085 A * | 10/1996 | Igarashi | A63F 9/0291 | 434/18 |
| 5,660,159 A * | 8/1997 | Clayton | F41B 11/54 | 124/59 |
| 6,530,368 B1 * | 3/2003 | Maeda | F41B 11/55 | 124/48 |
| 7,588,023 B2 * | 9/2009 | Kung | F41A 3/72 | 124/16 |
| 7,694,448 B2 * | 4/2010 | Iwasawa | F41B 11/644 | 42/54 |

(Continued)

*Primary Examiner* — Alexander R Niconovich
(74) *Attorney, Agent, or Firm* — Chun-Ming Shih; HDLS IPR Services

(57) ABSTRACT

A toy gun with simulated shaking bullet chain includes a gun body, a bolt, an actuator assembly, and a bullet chain. The bolt is movably arranged on the gun body. The actuator assembly includes a swing member and an elastic member. The swing member is pivotally attached to the gun body and formed on one side of the bolt. The elastic member is secured on the gun body and elastically abuts against the swing member. The swing member includes an actuation portion and a swing portion disposed respectively on two ends thereof. The bullet chain is mounted on one side of the gun body, and the bullet chain includes multiple bullets and a belt connected to the bullets. One of the bullets is connected to the swing portion. Accordingly, the toy gun may simulate the visual effect of a real gun during shooting.

7 Claims, 7 Drawing Sheets

(56) References Cited

U.S. PATENT DOCUMENTS

| | | | | |
|---|---|---|---|---|
| 8,127,753 | B1 * | 3/2012 | Brooks | F41B 11/55 124/66 |
| 8,387,605 | B2 * | 3/2013 | Brown | F41B 7/08 124/27 |
| 8,585,407 | B2 * | 11/2013 | Hu | F41B 11/642 434/18 |
| 8,800,541 | B2 * | 8/2014 | Hu | F41A 33/06 124/66 |
| 8,875,689 | B2 * | 11/2014 | Chor-Ming | F41B 11/89 124/80 |
| 8,875,690 | B2 * | 11/2014 | Chor-Ming | F41B 11/54 124/82 |
| 10,371,473 | B1 * | 8/2019 | Wei | F41B 11/55 |
| 2009/0101130 | A1 * | 4/2009 | Hu | F41A 33/06 124/80 |
| 2009/0127758 | A1 * | 5/2009 | Hu | F41B 11/644 267/167 |
| 2009/0151710 | A1 * | 6/2009 | Zimmerman | F41B 11/89 124/48 |
| 2010/0154765 | A1 * | 6/2010 | Klockener | F41A 9/79 124/51.1 |
| 2012/0138038 | A1 * | 6/2012 | Lee | A63H 5/04 124/80 |
| 2012/0240912 | A1 * | 9/2012 | Hu | F41B 11/646 124/80 |
| 2016/0258712 | A1 * | 9/2016 | Maeda | F41B 11/89 |

* cited by examiner

TOY GUN WITH SIMULATED SHAKING BULLET CHAIN

BACKGROUND OF THE INVENTION

Field of the Invention

The technical field relates to a toy gun, and in particular, to a toy gun with a simulated shaking bullet chain.

Description of Related Art

With the diverse development of modern living, some people choose casual recreational activities to relieve stress accumulated over time and some people choose to seek new and exciting recreational activities during their free time. Accordingly, toy guns of, such as, BB guns, paintball guns and air guns, have become one of the recreational activities drawing the attention of the modern people.

Most of the related BB bullets and paintball bullets for toy guns are in a ball shape and are concealed inside cartridge, user experience for these toy guns is significantly different from the experience in actual jungle warfare or street battle. Consequently, the visual sensation and thrill effect of the scenario experienced by the participants are significantly reduced.

In view of the above, the inventor of this disclosure seeks to overcome the aforementioned drawbacks through extensive research in conjunction with the theoretical applications. Accordingly, the goal of the inventor of this disclosure is to solve the problem mentioned above with an improved solution.

SUMMARY OF THE INVENTION

An objective of this disclosure is to provide a toy gun with a simulated shaking bullet chain. With the utilization of an actuator assembly to drive the bullet chain to shake, the visual effect of a real gun during shooting is thus achieved.

To achieve the aforementioned objective, this disclosure provides a toy gun with a simulated shaking bullet chain, including a gun body, a bolt, an actuator assembly, and a bullet chain. The bolt is movably arranged on the gun body. The actuator assembly includes a swing member and an elastic member. The swing member is pivotally attached to the gun body and disposed on one side of the bolt. The elastic member is fixed on the gun body and elastically abuts against the swing member. The swing member includes an actuating portion and a swing portion disposed respectively on two ends thereof. The bullet chain is mounted on one side of the gun body. The bullet chain includes a plurality of bullets and a belt connected to the plurality of bullets, and one of the plurality of bullets is connected to the swing portion. In addition, when the bolt moves forwardly and backwardly on the gun body, the bolt strikes the actuation portion, and the swing member is restored to an original position via an elastic deformation of the elastic member, and the swing portion drives the bullet chain to shake.

This disclosure may achieve the following technical effects. As the actuation portion is configured to be a triangular plate, the pushing and contact from the forward and backward movements of the bolt may be facilitated. With the configuration of a shaft passing through the opening hole of the bullet and disposed in the guiding slot, the stability and smoothness of the swing portion of the swing member during its forward and backward movements may be enhanced.

DETAILED DESCRIPTION OF THE INVENTION

Figure 1:
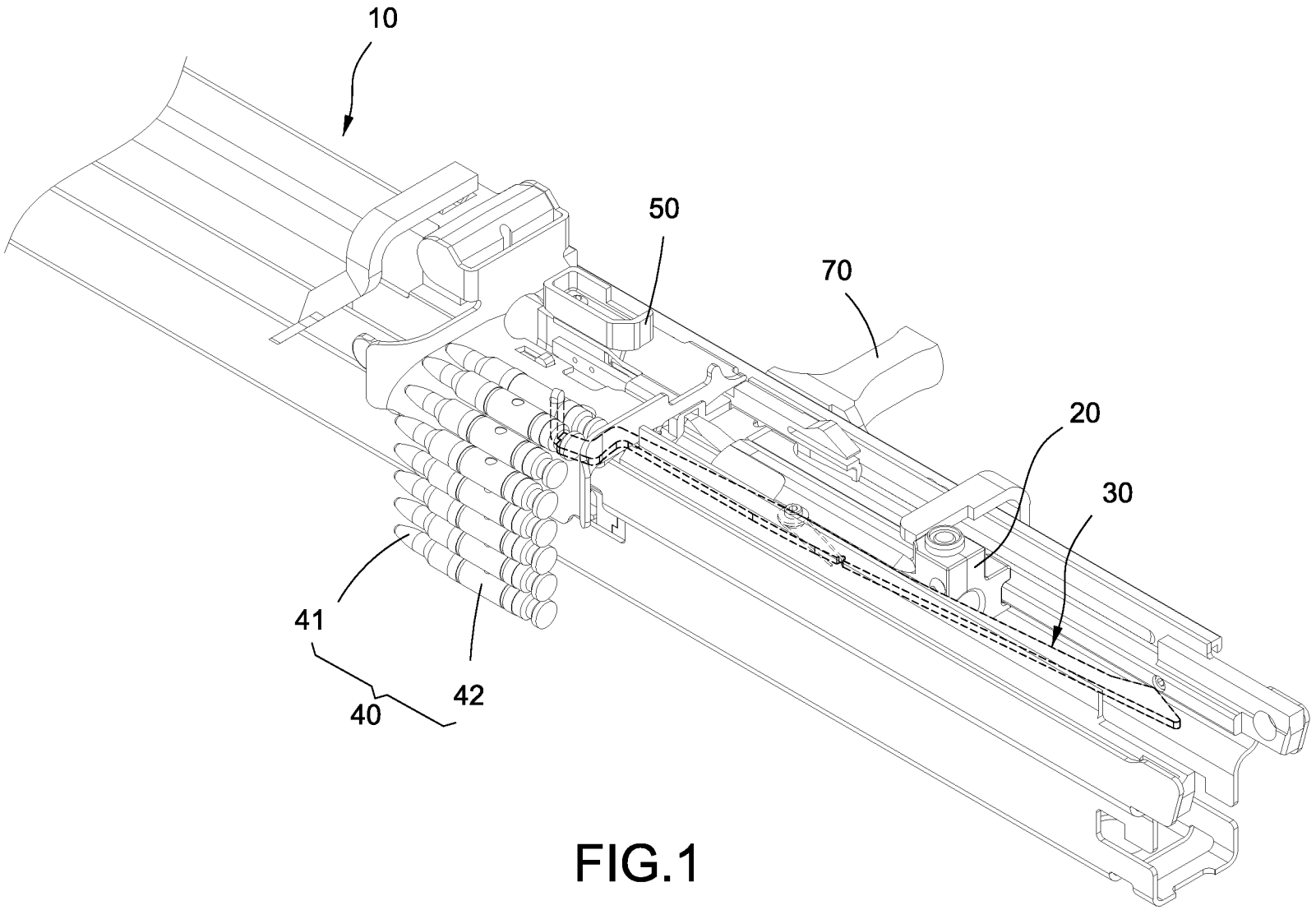
FIG. 1 is an assembly perspective view of the toy gun of this disclosure.
Figure 2:
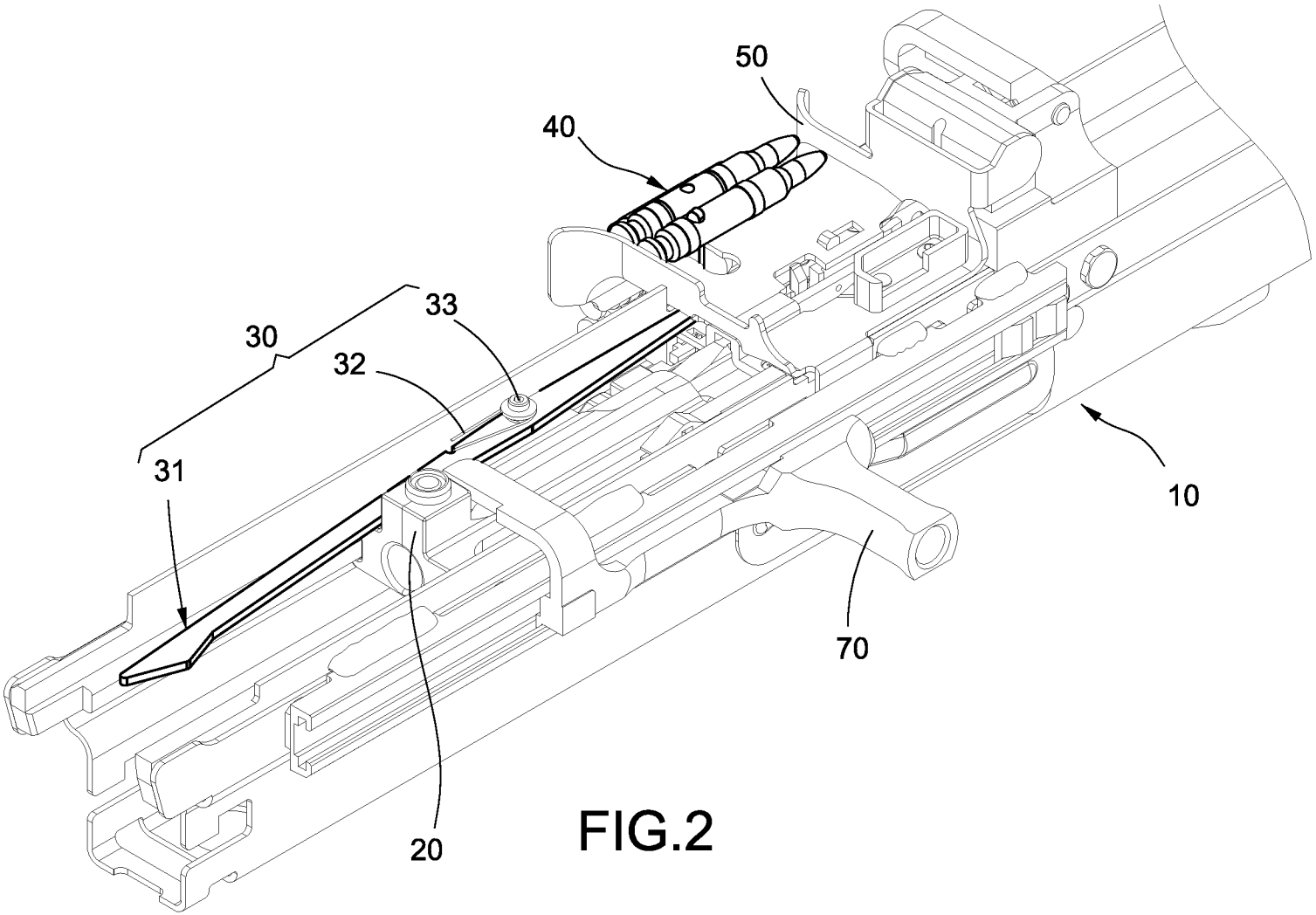
FIG. 2 is another perspective view of the toy gun of this disclosure viewed from another angle.
Figure 3:
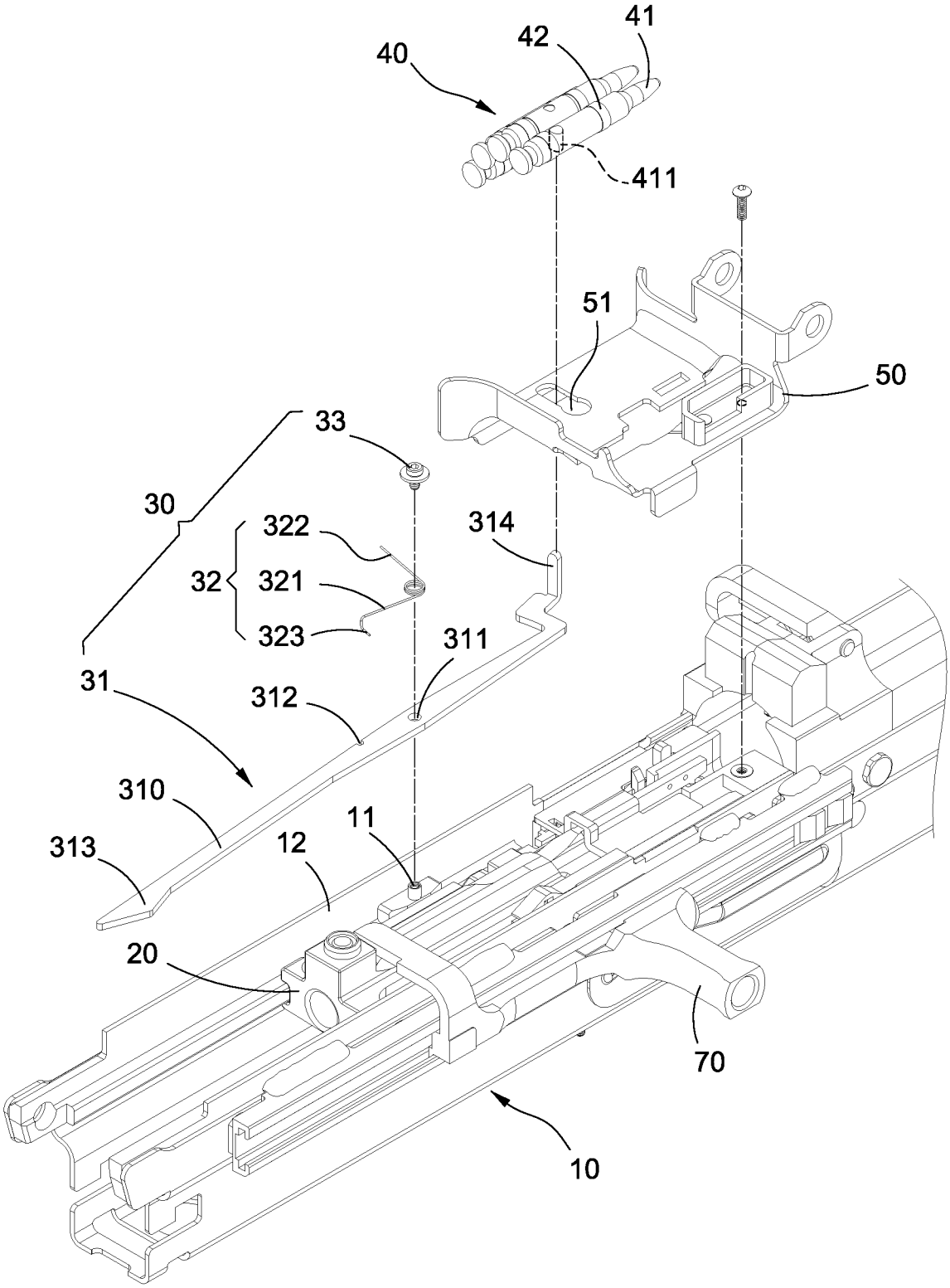
FIG. 3 is an illustration showing parts of the elements of the toy gun of this disclosure being detached from the gun body.
Figure 4:
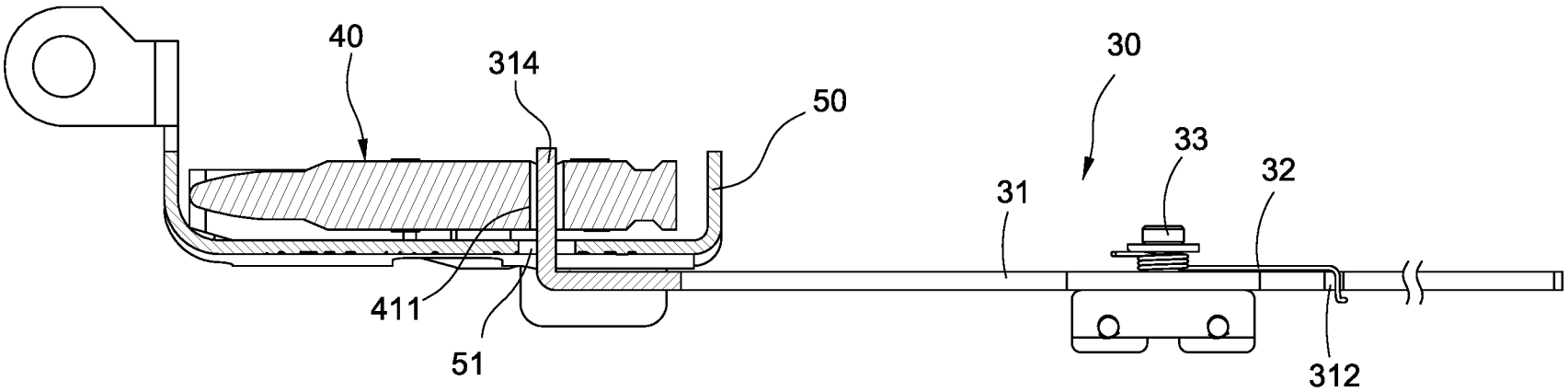
FIG. 4 is an assembly cross sectional view of the actuator assembly attached to the bullet chain of this disclosure.
Figure 5:
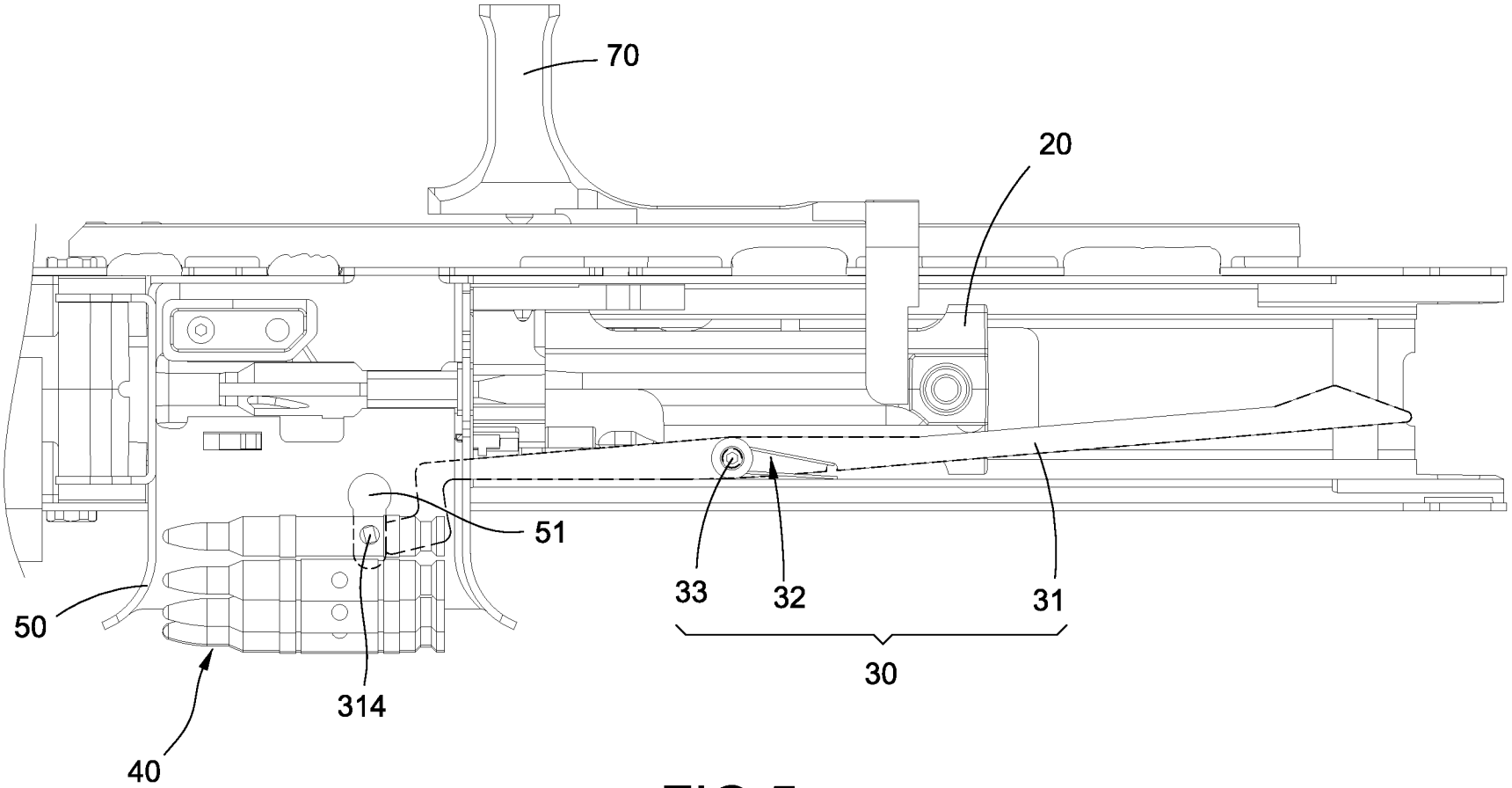
FIG. 5 is an assembly top view of the toy gun of this disclosure.

The following provides a detailed technical content of this disclosure along with the accompanied drawings. However, it shall be understood that the accompanied drawings are provided for reference and illustration purposes only such that they shall not be used to limit the scope of this disclosure.

As shown in FIG. 1 to FIG. 5, this disclosure provides a toy gun with a simulated shaking bullet chain including a gun body 10, a bolt 20, an actuator assembly 30 and a bullet chain 40.

The gun body 10 includes a bore and is connected to the relevant elements such as a trigger assembly, a barrel, and a gunsight etc. The bolt 20 is movably accommodated in the bore of the gun body 10.

The actuator assembly 30 includes a swing member 31, an elastic member 32 and a screw fixation member 33. The gun body 10 includes a screw stud 11, and the screw stud 11 includes a wall plate 12 disposed on one side thereof. The swing member 31 includes a bar shape plate 310, and the bar shape plate 310 includes a through hole 311 formed and disposed on a center location thereof. The swing member 31 is pivotally attached and sleeved to the screw stud 11 via the through hole 311 and fastened onto the screw stud 11 by the screw fixation member 33, thereby the swing member 31 is formed and disposed on one side of the bolt 20.

In an exemplary embodiment of this disclosure, the elastic member 32 is a torsion spring mounted on the outer perimeter of the screw stud 11 and confined by the screw fixation member 33. The elastic member 32 includes a first arm 321 and a second arm 322 extended therefrom. The first arm 321 includes a hook 323 formed on an end portion thereof, and the bar shape plate 310 includes an insertion slot 312 formed and disposed on one side thereof adjacent to the through hole 311. The second arm 322 abuts against the wall plate 12 of the gun body 10, and the first arm 321 is inserted into the insertion slot 211 by the hook 323, thereby the elastic member 32 may elastically abut against the swing member 31 to restore to an original position.

The bar shape plate 310 includes an actuation portion 313 and a swing portion 314 disposed on two ends thereof away from the through hole 311 respectively. The actuation portion 313 is substantially, but not limited to, a triangular plate. The swing portion 314 is formed by bending an end portion of the bar shape plate 310 upwardly. The swing portion 314 is substantially, but not limited to, a shaft.

The bullet chain 40 is mounted and hung on one side of the gun body 10. The bullet chain 40 includes a plurality of bullets 41 and a belt 42. All bullets 41 are aligned and connected with each other through the belt 42. In addition, the first bullet 41 includes an opening hole 411. The opening hole 411 is provided to allow the swing portion 314 to penetrate therethrough. Furthermore, the bullet 41 described in this specification may be any item or tool, such as an imitation bullet or other fake bullet, applicable to a toy gun.

Furthermore, the toy gun of this disclosure further includes a retaining base 50 secured on the gun body 10 and positioned above the swing portion 314. The retaining base 50 includes a guiding slot 51, and the swing portion 314 protrudes outwardly from the guiding slot 51 to further connect to the opening hole 411 of the bullet 41. The bullet chain 40 is configured to hang on one side of the gun body 10 along with the side of the retaining base 50.

Furthermore, the toy gun of this disclosure further includes a pull handle member 70 used to perform the positioning of the bolt 20 before shooting.

Figure 6:
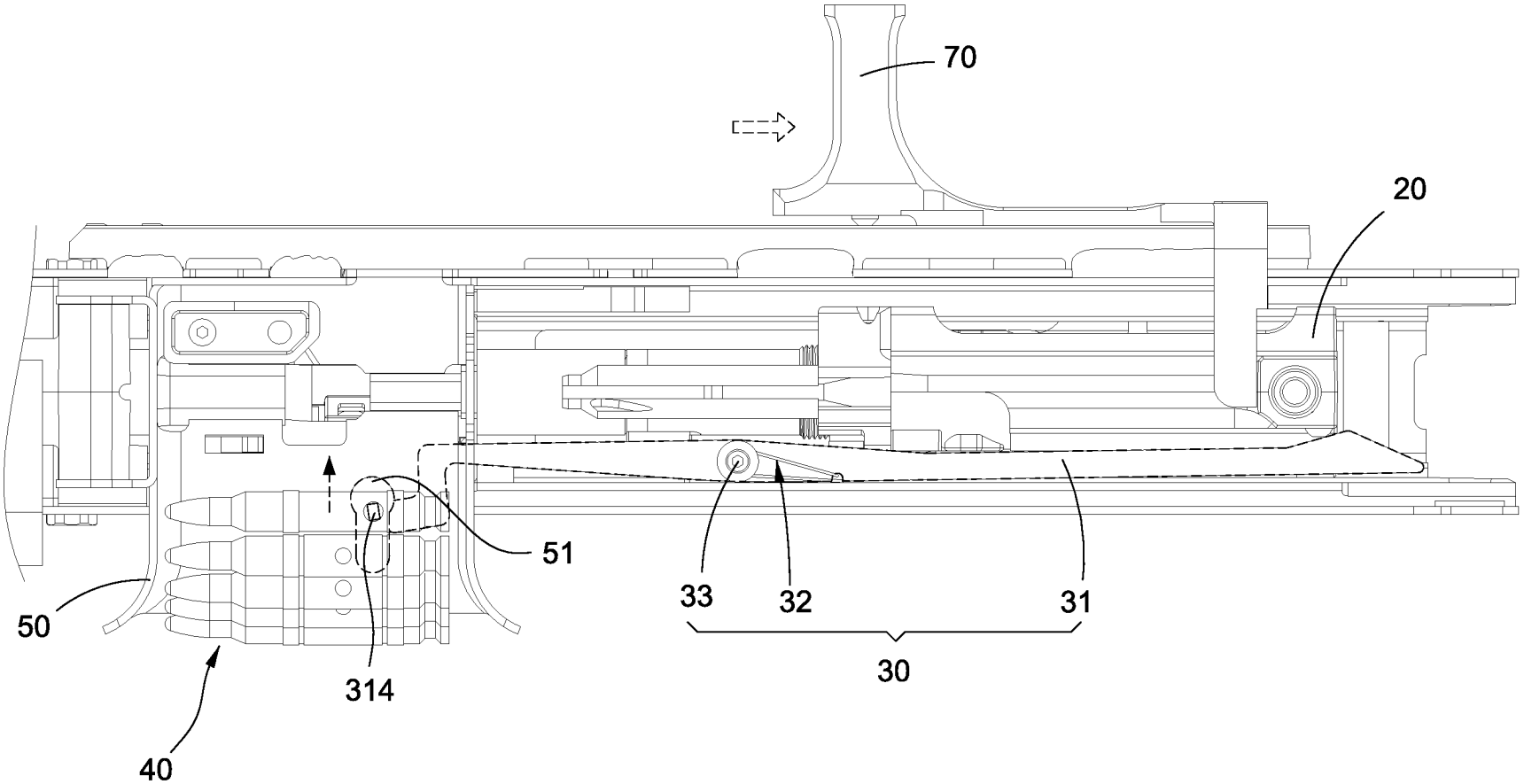
FIG. 6 is a top view showing a state of use of the toy gun of this disclosure.
Figure 7:
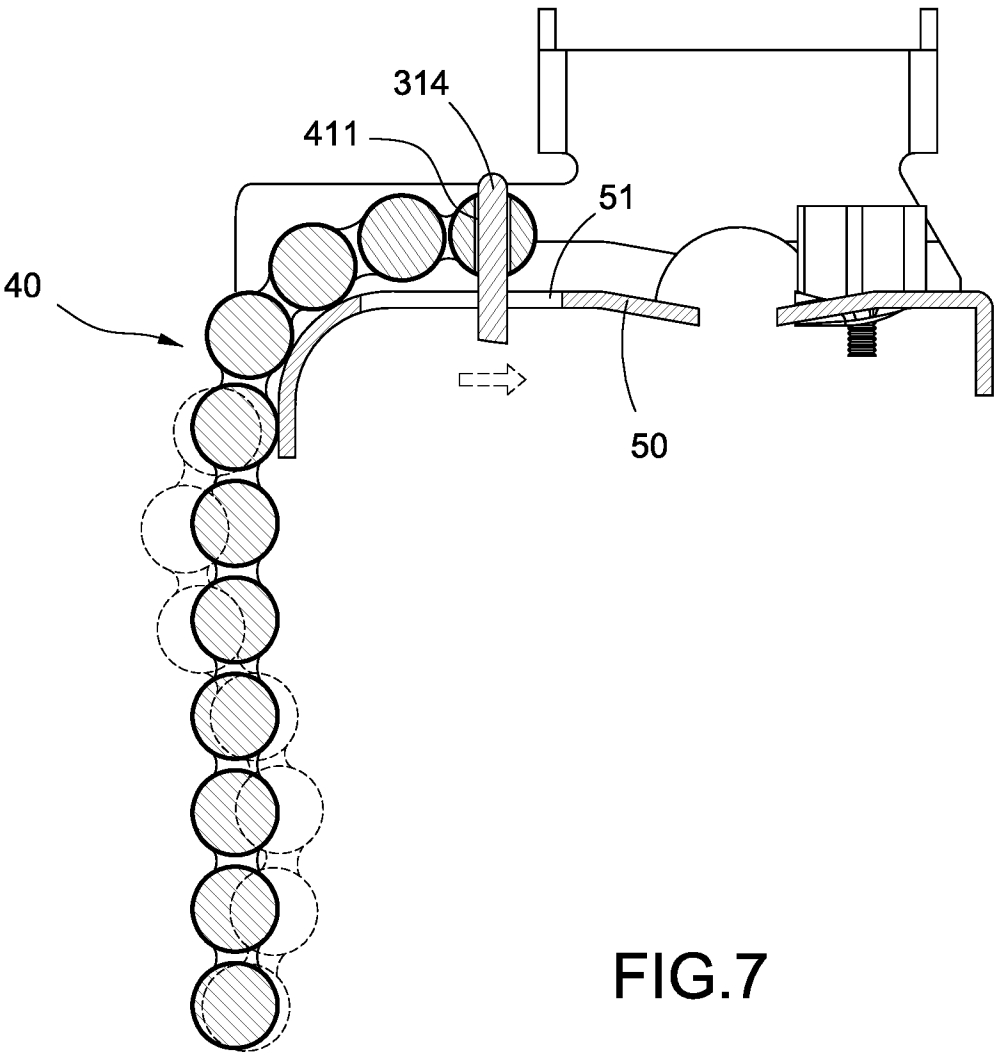
FIG. 7 is a cross sectional view showing a state of use of the swing portion attached to the bullet chain of this disclosure.

As shown in FIG. 6 and FIG. 7, during the operation of the toy gun, the bolt 20 is pushed by the pull handle member 70 to move toward the rear side of the gun body 10 and is positioned. After the trigger is triggered, the pull handle member 70 and the bolt 20 are released such that the bolt 20 moves toward the front side of the gun body 10 and the BB bullet or paintball bullet is shot out of the barrel. Next, when the bolt 20 moves forwardly and backwardly in the bore of the gun body 10, the bolt 20 strikes the actuation portion 313 of the swing member 31 as the bolt 20 moves toward the rear side of the gun body 10. The swing member 31 rotates pivotally and moves to compress the elastic member 22. When the bolt 20 moves away from the actuation portion 213, the elastic member 32 may make the swing member 31 restore to the original position, as the initial position shown in FIG. 5, by the elastic deformation. Consequently, the swing portion 314 may drive the bullet chain 40 to shake.

The above is only the feasible embodiments of this disclosure, and not intended to limit the protection scope of this disclosure. Equivalent changes and structural modifications based on the description and drawings of this disclosure should be deemed to be within the protection scope of this disclosure.

What is claimed is:

1. A toy gun with a simulated shaking bullet chain, the toy gun comprising:

a gun body;

a bolt, movably arranged on the gun body;

an actuator assembly, comprising a swing member and an elastic member, the swing member pivotally attached to the gun body and disposed on one side of the bolt, the elastic member fixed on the gun body and elastically abutting against the swing member, the swing member comprising an actuating portion and a swing portion disposed respectively on two ends thereof; and a bullet chain, mounted on one side of the gun body and comprising a plurality of bullets and a belt connected to each of the plurality of bullets, one of the plurality of bullets connected to the swing portion;

wherein when the bolt moves forwardly and backwardly on the gun body, the bolt strikes the actuation portion, and the swing member is restored to an original position via an elastic deformation of the elastic member, and the swing portion drives the bullet chain to shake.

2. The toy gun with a simulated shaking bullet chain according to claim 1, wherein the swing member comprises a bar shape plate, the actuation portion comprises a triangular plate disposed on one end of the bar shape plate, and the swing portion comprises a shaft disposed on another end of the bar shape plate.

3. The toy gun with a simulated shaking bullet chain according to claim 2, wherein the actuator assembly further comprises a screw fixation member, the gun body comprises a screw stud, the bar shape plate comprises a through hole, the swing member is pivotally attached to the screw stud via the through hole, and the screw fixation member is fastened on the screw stud.

4. The toy gun with a simulated shaking bullet chain according to claim 3, wherein the elastic member comprises a torsion spring mounted on an outer perimeter of the screw stud and confined by the screw fixation member.

5. The toy gun with a simulated shaking bullet chain according to claim 4, wherein the gun body comprises a wall plate disposed on one side of the screw stud, the torsion spring comprises a first arm and a second arm extended therefrom, and a hook is disposed on an end portion of the first arm, the bar shape plate comprises an insertion slot disposed on one side thereof, the second arm abuts against the wall plate, and the first arm is inserted into the insertion slot by the hook.

6. The toy gun with a simulated shaking bullet chain according to claim 1, wherein an opening hole is disposed on the bullet connected to the swing portion, the swing portion comprises a shaft passing through the opening hole.

7. The toy gun with a simulated shaking bullet chain according to claim 6, further comprising: a retaining base fixed on the gun body and located on the swing portion, and comprising a guiding slot passed through by the shaft.

* * * * *